US007232045B2

(12) United States Patent
Ophardt et al.

(10) Patent No.: US 7,232,045 B2
(45) Date of Patent: Jun. 19, 2007

(54) FLUID DISPENSER LOCK DEFEATER

(75) Inventors: Heiner Ophardt, Vineland (CA); Srdjana Jankovic, Hamilton (CA)

(73) Assignee: Hygiene-Technik Inc., Beamsville, Ontario (CA)

( * ) Notice: Subject to any disclaimer, the term of this patent is extended or adjusted under 35 U.S.C. 154(b) by 267 days.

(21) Appl. No.: 11/085,067

(22) Filed: Mar. 22, 2005

(65) Prior Publication Data

US 2006/0213929 A1 Sep. 28, 2006

(30) Foreign Application Priority Data

Feb. 9, 2005 (CA) ..... 2496412

(51) Int. Cl.
*B67D 5/06* (2006.01)

(52) U.S. Cl. ..... 222/180; 222/181.3; 222/153.01

(58) Field of Classification Search ..... 222/180, 222/181.1–181.3; 221/283

See application file for complete search history.

(56) References Cited

U.S. PATENT DOCUMENTS 5,373,970 A 12/1994 Ophardt

*Primary Examiner*—Kevin Shaver
*Assistant Examiner*—Stephanie E. Tyler
(74) *Attorney, Agent, or Firm*—Riches, McKenzie & Herbert LLP

(57) ABSTRACT

An object of the invention is to provide a dispenser which permits its cover to be either locked when closed or unlocked a dispensing device including a lock mechanism for locking a cover to a housing and providing therewith a blocking member which is either coupled to the housing in an inoperative position or can be coupled to the housing in a position which prevents locking of the lock mechanism. The blocking member may preferably be integrally formed from plastic as the same material as another component of the dispenser, preferably from injection molded integrally with a back plate for the housing, at a location which is not visible when the dispenser is used and with the blocking member being removably connected to the housing back plate by a frangible connection which may readily be broken to separate the blocking member from the housing back plate such that the blocking member may be suitably positioned and coupled to the dispenser in a position which prevents locking of the lock mechanism.

10 Claims, 8 Drawing Sheets

FLUID DISPENSER LOCK DEFEATER

SCOPE OF THE INVENTION

This invention relates to dispensers having movable covers and more particularly to a block mechanism removably carried by a back plate for a dispenser and adapted to secure a releasable lock for the cover in an inoperative position.

BACKGROUND OF THE INVENTION

Soap dispensers are known having a cover which can be moved between an open and closed position as for filling the dispensers with soap as, for example, by the removal and replacement of disposable soap containers. Frequently, the cover is mounted on a dispenser housing and adapted to assume a closed position in which it is locked to the housing, as to a back plate, against opening other than by disengaging a lock mechanism such as by use of a key to be turned or pushed. While such lock mechanisms are advantageous to reduce vandalism as in school washroom environments, the use of a key as a requirement to open a cover of dispenser is not desirable in other environments as where vandalism is not high and greater ease of access to dispenser is desired.

To overcome the disadvantages of previously known devices the present invention provides a soap dispenser with a lock mechanism for locking a cover to a housing back plate and including a blocking member, provided preferably as a removable integral portion of the back plate, which can be removed and when suitably positioned prevents locking of the lock mechanism.

The present invention provides a dispensing device including a lock mechanism for locking a cover to a housing and providing therewith a blocking member which is either coupled to the housing in an inoperative position or can be coupled to the housing in a position which prevents locking of the lock mechanism. The blocking member may preferably be integrally formed from plastic as the same material as another component of the dispenser, preferably from injection molded integrally with a back plate for the housing, at a location which is not visible when the dispenser is used and with the blocking member being removably connected to the housing back plate by a frangible connection which may readily be broken to separate the blocking member from the housing back plate such that the blocking member may be suitably positioned and coupled to the dispenser in a position which prevents locking of the lock mechanism. Forming the blocking member as an integral part of one of the elements of the dispenser, preferably a back plate, avoids the need for handling of a separate element. The blocking member is preferably provided on the dispenser preferably on a back plate in a location that with the cover open it can be readily accessed such that after the dispenser may have been installed as for locking usage, the blocking member may then be removed and subsequently applied to the dispenser to provide for use of the dispenser in a manner for which there is no locking of the cover.

In one aspect the present invention provides a fluid dispenser having a back plate for mounting to a wall and a cover mounted to the back plate for relative movement (1) between a closed position and a raised intermediate position by relative vertical sliding and (2) between the raised intermediate position and an open position by relative pivoting; in the closed position first catch members on the cover engaging first catch members on the back plate to prevent relative pivoting of the cover and back plate, in the closed position second catch members on the cover engaging second catch members on the back plate to prevent relative vertical sliding of the cover and back plate, one of the second catch members being resiliently deflectable to disengage the second catch member and permit vertical sliding of the cover and back plate between the closed and intermediate position, in the intermediate position the first catch members do not engage and the second catch members do not engage such that when in the intermediate position the cover is free for pivoting to the open position, a blocking member adapted to be engaged on one of the cover and the back plate to resilient deflect the resiliently deflectable one of the second catch members and maintain the same in a position in which the two second catch members do not engage, the blocking member carried by and removable secured to the back plate in an inoperative position, the blocking member manually removable from the inoperative position for engagement on the resiliently deflectable one of the catch member.

Preferably the back plate includes an opening through the back plate, the blocking member received in the opening coupled to the back plate in the inoperative position.

More preferably the blocking member and back plate are integrally formed together as a unitary member by injection molding with the blocking member secured to the back plate in the inoperative position by a frangible member which can be manually broken for removal of the blocking member to permit it to be removed from being secured to the back plate in the inoperative position and to be engaged with one of the cover and back plate to engage the resiliently deflectable one of the second catch members and maintain the same in a position in which the two second catch members do not engage.

BRIEF DESCRIPTION OF THE DRAWINGS

Further aspects and advantageous of this present invention will become apparent from the following description taken together with the accompanying drawings in which.

DETAILED DESCRIPTION OF THE DRAWINGS

Figure 1:
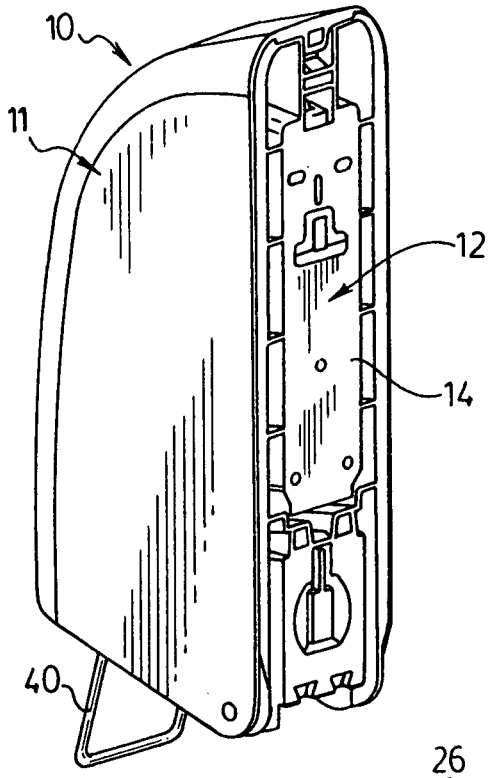
FIG. 1 is a rear pictorial view of an assembled dispenser in accordance with the present invention with a cover in a closed position locked to back plate.
Figure 2:
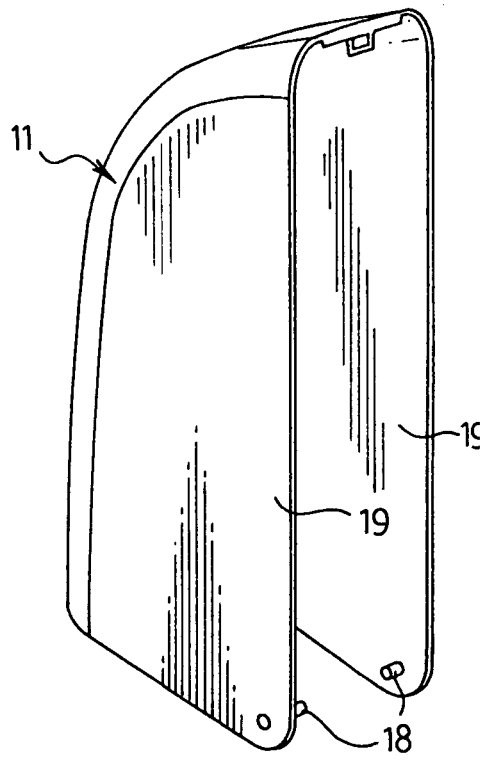
FIG. 2 is a rear pictorial view of the cover for the dispenser of FIG. 1.

Reference is made to FIGS. 1 to 11 which illustrate a preferred embodiment of dispenser 10 in accordance with the present invention which includes a cover 11 and a back plate 12. The back plate 12 is for mounting with a rear surface 14 engaged on a wall (not shown) to present a front surface 15 directed away from the wall. The back plate 12 is shown with forwardly projecting side flanges 16 carrying vertical slots 17 on each such side flange 16 to receive inwardly extending stub axles 18 carried and extending inwardly on opposite side walls 19 of cover 11.

Figure 4:
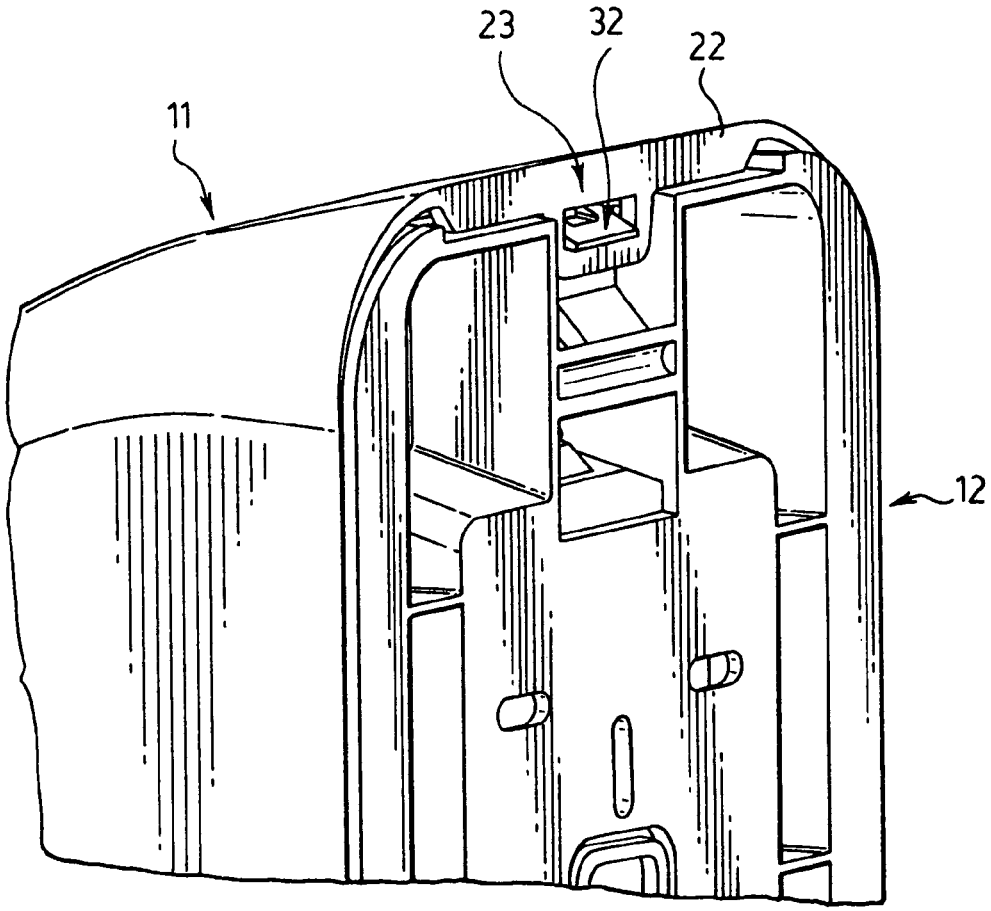
FIG. 4 is an enlarged view of an upper rear portion of FIG. 1 with the cover is a closed position.
Figure 5:
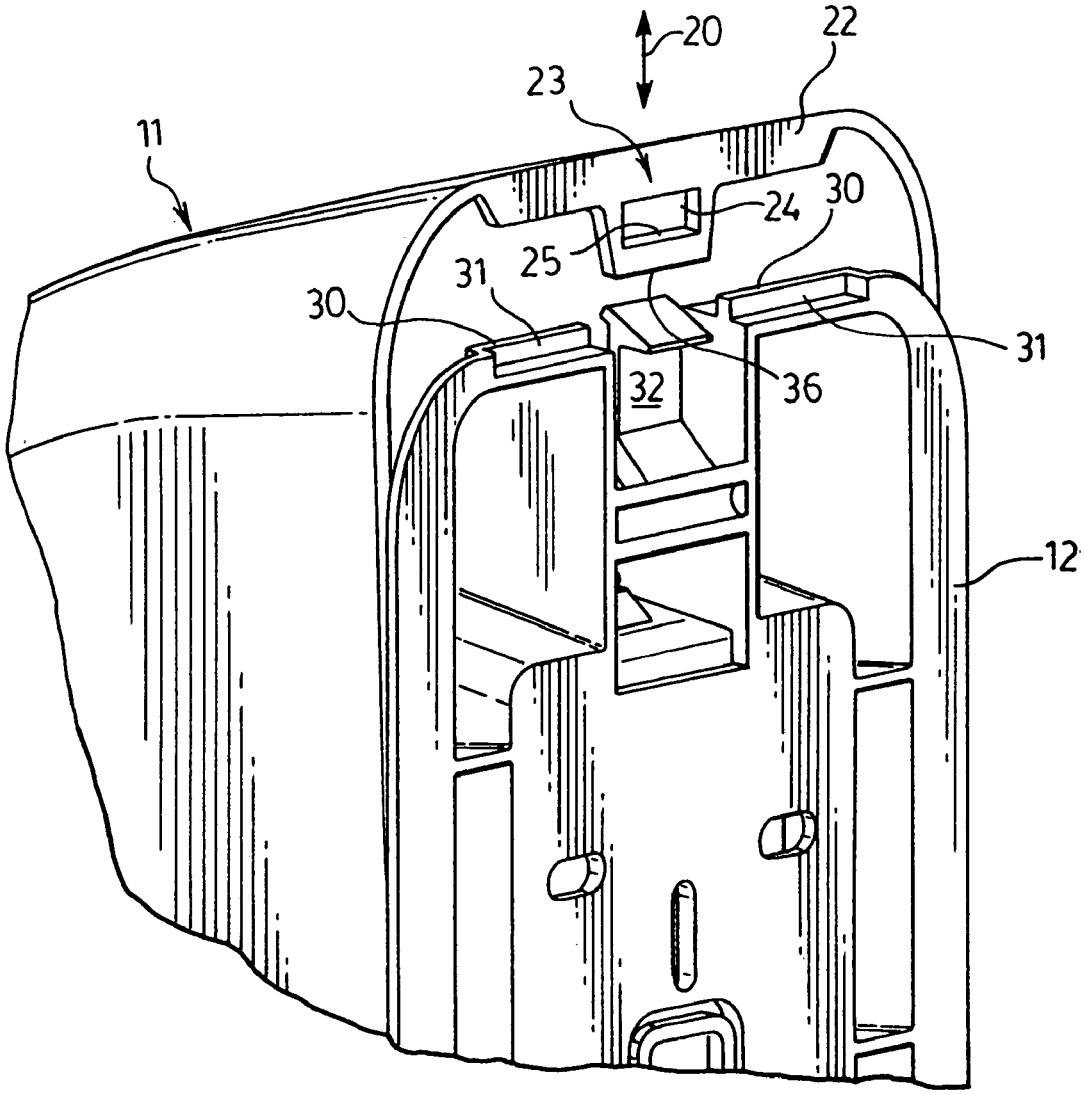
FIG. 5 is a view similar to FIG. 4 but with the cover in a raised intermediate position.
Figure 6:
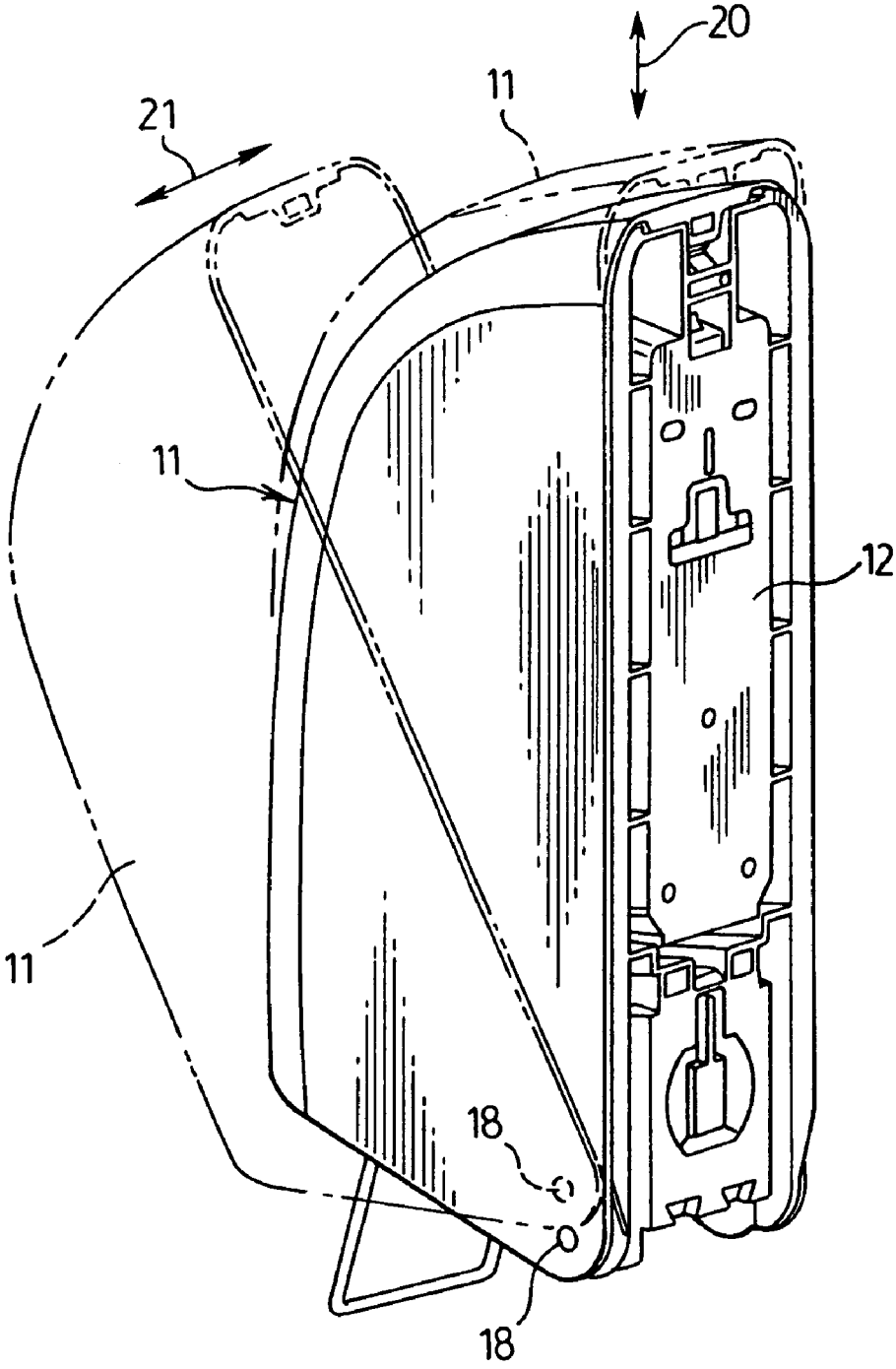
FIG. 6 is a rear pictorial view identical to FIG. 1 but showing the cover in dotted lines and dashed lines in the intermediate position and a partially open position, respectively.

The cover 11 is capable of moving between a lower closed position shown in solid lines in FIGS. 1 and 6, a raised intermediate position shown in dotted lines in FIG. 4 and in solid lines in FIG. 5 by reason of the axles 18 being vertically slidable in the slots 17 for relative movement of the cover 11 relative the back plate 12 in the direction of the arrow 20. The cover plate 11 is also capable of moving between the raised intermediate position shown in dotted lines in FIG. 2 and a open position by pivoting of the cover 11 about its axles 18 when the axles 18 are received in an upper portion of the slot 17 as in the direct of the arrow indicated 21 in FIG. 6 which shows the cover 11 in dashed lines in a partially open position from which the cover 11 may pivot further downwardly to a fully open position.

Figure 10:
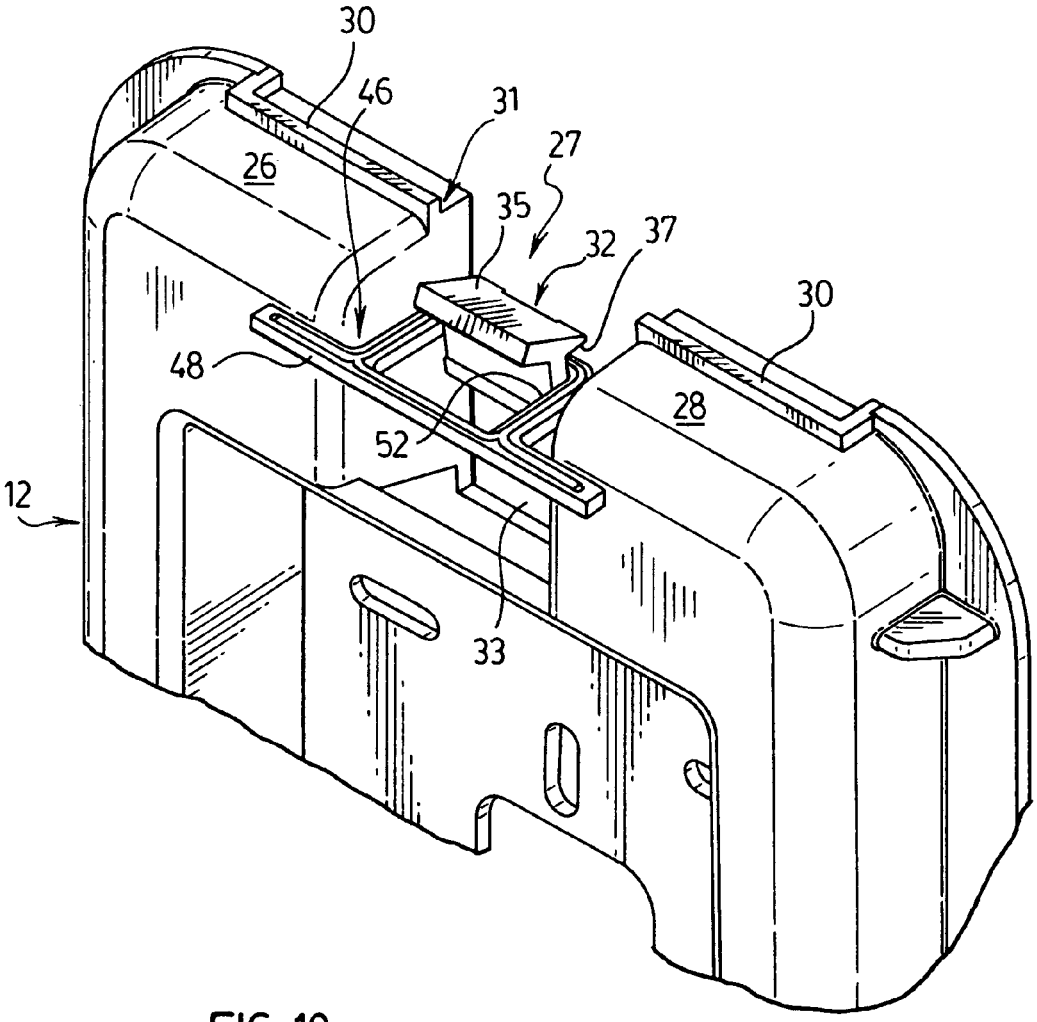
FIG. 10 is an enlarged perspective front view of the back plate with the block member in place to prevent locking.

FIG. 4 illustrates the cover 11 in a lower closed position. FIG. 5 illustrates the cover 11 in the raised intermediate position. The cover 11 moves relative to the back plate 12 between the position of FIG. 4 and the position of FIG. 5 merely by sliding vertically in the direction of arrows 20. As best seen in FIG. 5, the cover 11 carries a downwardly directed upper rear flange 22 which includes a central downwardly extending tab 23 with a lower camming surface 36. The tab 23 has a catch opening 24 there through provided with an upwardly directed lower catch surface 25. As best seen in FIGS. 5 and 10, the back plate 12 has a pair of raised shoulders 26 and 28 at the top rear of the back plate 12 separated by a central front to rear extending slotway 27. Each of the raised shoulders 26 and 28 carries an upwardly extending catch flange 30 presenting a rearwardly directed catch surface 31. The back plate carries a finger-like latch member 32 secured at a lower end 33 to the base of the slotway 27 and extending upwardly to a distal end. The latch member 32 carries at its distal end a bevelled upwardly and rearwardly directed cam surface 35 which extends downwardly towards the rear. A downwardly directed catch shoulder 37 is provided under the rear of the cam surface 35 adapted to engage on the catch surface 35 of the tab 23.

Referring to FIG. 5, in the raised intermediate position, the rear flange 22 of the cover 11 is rearward of the catch surfaces 31 on the catch flanges 30 on the shoulders 26 and 28 on either side of the slotway 27 and the tab 23 is above the slotway 27 and above the cam surface 35 of the latch member 32. On downward sliding of the cover 11 from the position of FIG. 4 to the position of FIG. 5, the rear flange 22 comes to be placed behind the catch flanges 30 and the lower camming surface 36 of the tab 32 engages on the upwardly directed cam surface 35 of the latch member 32 interacting to resiliently deflect the latch member 32 forwardly to an extent that the tab 23 may pass downwardly therepast and the latch member 32 will become to be disposed within the catch opening 24 of the tab 23 with the catch surface 25 of the tab 23 engaging on the catch shoulder 37 of the latch member 32.

In the locked and closed position of FIG. 4 the engagement between the rear flange 22 and the catch surface 31 prevents forward pivoting of the cover 11 until the cover 11 may be raised vertically. The engagement of the tab 23 and the latch member 32 prevents vertically raising of the cover 11.

To unlock the cover, a key-like tool or awl is to be inserted through a hole (not shown) in the central upper top of the cover above the latch member 32 to engage on the cam surface 35 of the latch member 32 and by vertically downwardly directed forces applied to the upwardly directed cam surface 35 force the resilient latch member 32 to move forwardly sufficiently to be out from engagement with the tab 23.

The cover 11 is desired to be moved to an open position as for example to permit access to the interior of the dispenser as to provide a renewed supply of fluid to be dispensed by the dispenser, for example to replace a disposable fluid container. The nature of a pumping mechanism which is activated so as to dispense fluid from the dispenser may be any known system including manually operated systems or automated systems. For example a suitable dispensing mechanism as taught in U.S. Pat. No. 5,373,970 issued Dec. 20, 1994 may be adopted utilizing for example a manual activation lever 40 shown in FIG. 1.

The back plate 12 is preferably injection moulded from plastic as a unitary element so as to provide the latch member 32 to be resiliently deflectable from an inherent unbiased rearward rest position as shown in FIGS. 1 and 4 forwardly and when deflected forwardly will have an inherent bias to assume the unbiased rearward rest position. In final closing of the cover 11, the cover comes to have its rear tab 23 positioned above the cam surface 35 of the latch member 32. With vertical downward movement, the lower camming surface 36 of the tab 23 engages the cam surface 35 and cams the latch member 32 to deflect forwardly such that the latch member 32 is deflected inwardly of the tab 23. The tab 23 then moves downwardly until its catch opening 24 is below the catch shoulder 37 where upon the latch member 32 deflects rearwardly such that the catch shoulder 37 engages the catch surface 25 to assume a locked position in which movement of the cover 11 upwardly is prevented.

To open the cover, the latch member 32 must be deflected forwardly to disengage the catch shoulder 37 from the catch surface 35. This may be accomplished many ways but preferably by inserting the pin-like key or other tool vertically downward through the keyhole (not shown) in the top of the cover 11 above the latch member 32 to engage the cam surface 35 and manual deflect the latch member 32 forwardly.

Figure 3:
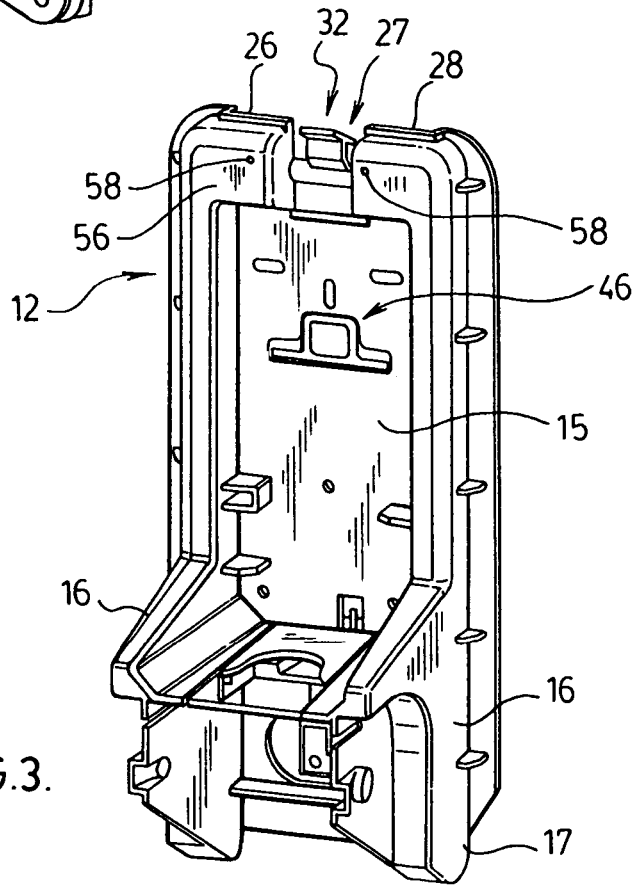
FIG. 3 is a front pictorial view of the back plate of the dispenser of FIG. 1.
Figure 7:
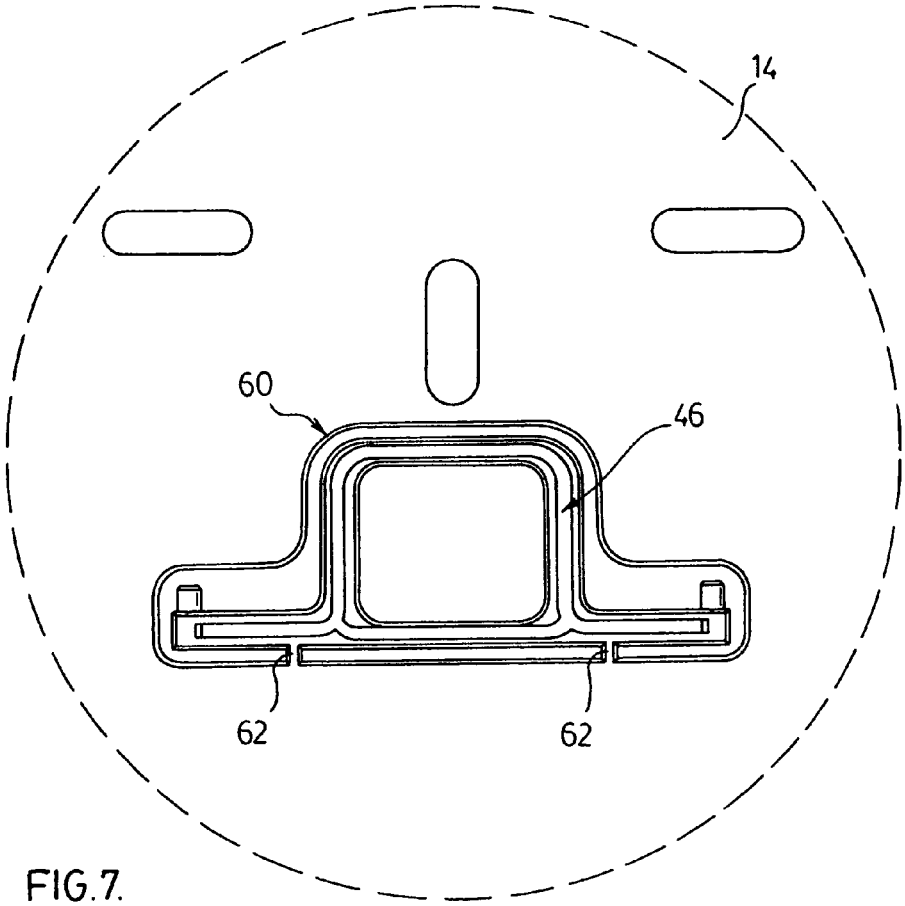
FIG. 7 is an enlarged front view of a portion of the back plate of FIG. 3 carrying a block member.
Figure 8:
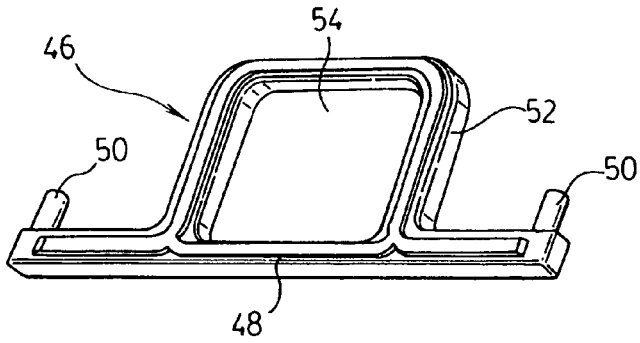
FIG. 8 is a front perspective view of the block member of FIG. 7 as removed from the back plate.
Figure 9:
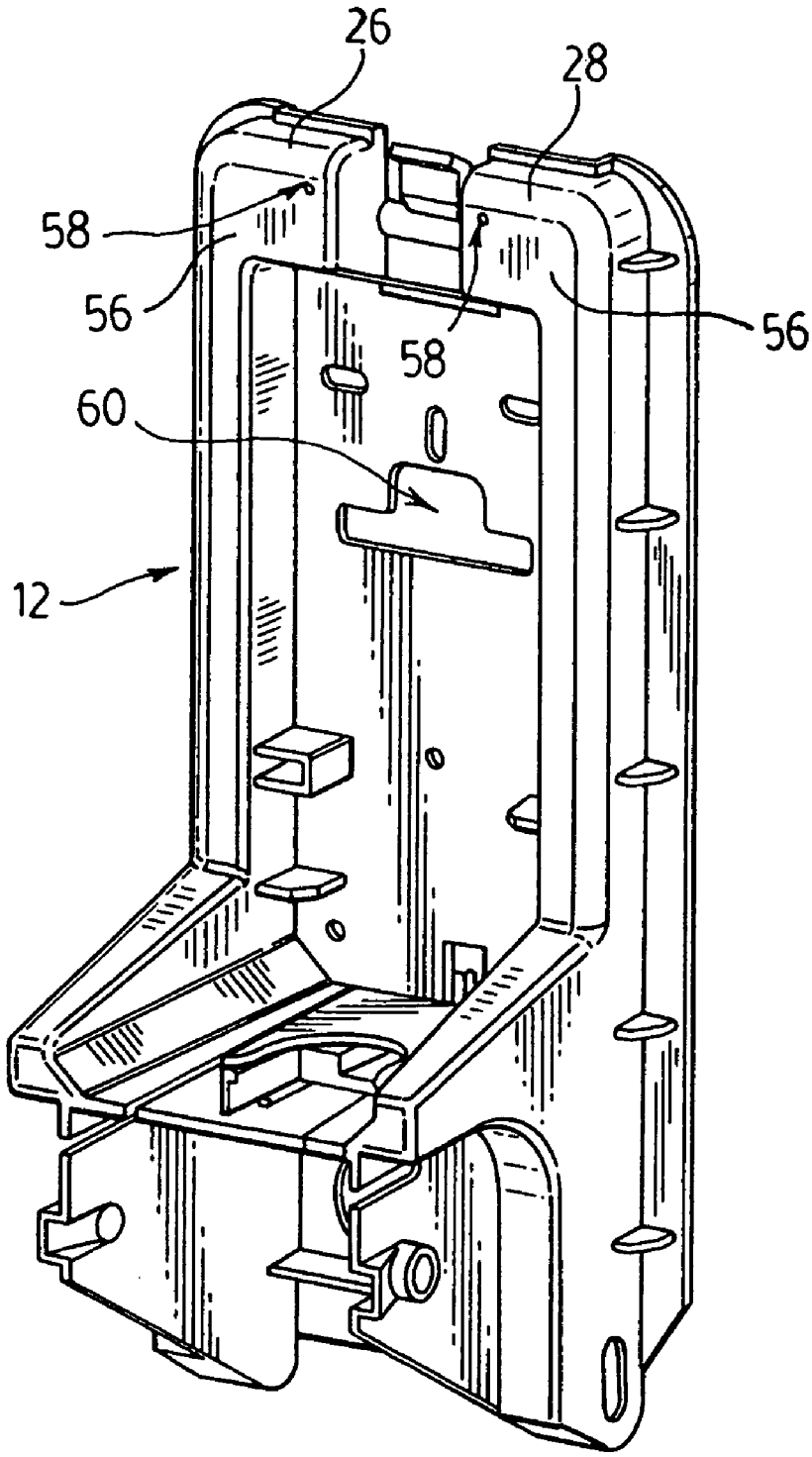
FIG. 9 is view similar to FIG. 3 but with the block member removed from the back plate.
Figure 11:
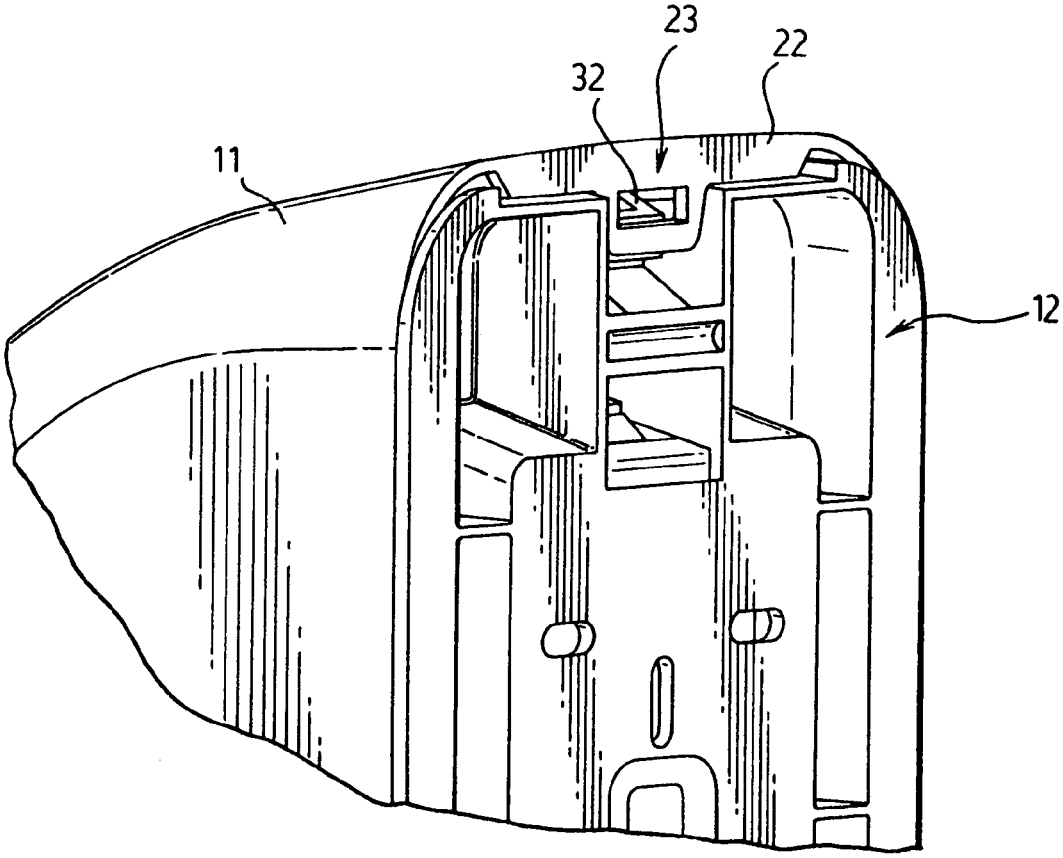
FIG. 11 is a rear view the same as in FIG. 4 but of the assembled cover and back plate with the block member in place.

Reference is made to FIG. 7 which shows a block member 46 comprising an elongate bridge member 48 carrying two rearwardly extending locating pins 50 at its ends and a rearwardly extending U-shaped loop 52 at its center. The loop 52 provides a central opening 54 between the loop 52 and the bridge member 48. As best seen in FIGS. 10 and 11, the block member 46 is adapted to engage the latch member 32 and hold the latch member 32 in a forward inactive position in which the latch member 32 does not interact with the tab 23 on the cover 11 and the cover 11 is free to move vertically from a fully closed position to the intermediate position without the need to move the latch member 32. The front surface 56 of each shoulders 26 and 28 of the back plate 12 has an opening 58 as seen in FIG. 3 extending rearwardly there into adapted to receive a respective one of the locating pins 50 of the bridge member 48. With the pins 50 of the bridge member 48 received in the openings 58, the bridge member 48 spans between the shoulders 26 and 28 such that with the latch member 32 received within the loop 52, the latch member 32 is drawn rearwardly and held in an inoperative position.

The block member 46 is preferably integrally formed with the back plate when the back plate is formed by injection moulding. In this regard, as best seen in FIG. 7, the back plate has in an opening 60 of complementary shape to the block member 46 and in which the block member 46 is formed by injection molding to be integral with the back plate 12. The block member 46 is joined to the back plate 12 by two frangible arms 62 and is manually severable from the back plate 12 by means of the block member 46 being connected to the back plate 12 merely by frangible arms 62 which can easily be broken.

When the block member 46 is coupled to the back plate 12 in a manner to render the latch member 32 inoperative, in moving from a raised intermediate position similar to that shown in FIG. 5 to a closed position as shown in FIG. 11 the latch member 32 on back plate 12 and the tab 23 on the cover 11 do not engage or interact such that there is on closing no impediment to raising the cover 11 vertically from the closed position of FIG. 11 to the intermediate position. In the closed but locked position of FIG. 11, the rear flange 22 on the cover 11 engages on the catch flange 30 on the back plate 12 to prevent forward pivoting of the cover 11 relative to the back plate 12 as illustrated in FIG. 11.

While the invention has been described with reference to preferred embodiments, many modifications and variations will now occur to persons skilled in the art. For a definition of the invention, reference is made to the following claims.

We claim:

1. A fluid dispenser having a back plate for mounting to a wall and a cover mounted to the back plate for relative movement (1) between a closed position and a raised intermediate position by relative vertical sliding, and (2) between the raised intermediate position and an open position by relative pivoting;

in the closed position, a first catch member on the cover engaging a first catch member on the back plate to prevent relative pivoting of the cover and back plate, in the closed position, a second catch member on the cover engaging a second catch member on the back plate to prevent relative vertical sliding of the cover and back plate, one of the second catch members being resiliently deflectable to disengage the second catch member and permit vertical sliding of the cover and back plate between the closed and intermediate position, in the intermediate position, the first catch members do not engage and the second catch members do not engage such that when in the intermediate position, the cover is free for pivoting to the open position, a blocking member adapted to be engaged on one of the cover and the back plate to resiliently deflect the resiliently deflectable one of the second catch members and maintain the same in a position in which the second catch members do not engage, the blocking member carried by and removably secured to the back plate in an inoperative position, the blocking member manually removable from the inoperative position for engagement on the resiliently deflectable one of the second catch members.

2. A dispenser as claimed in claim 1 wherein the back plate includes an opening through the back plate, the blocking member received in the opening coupled to the back plate in the inoperative position.

3. A dispenser as claimed in claim 2 wherein the blocking member and back plate are integrally formed together as a unitary member by injection molding with the blocking member secured to the back plate in the inoperative position by a frangible member which can be manually broken for removal of the blocking member to permit it to be removed from being secured to the back plate in the inoperative position and to be engaged with one of the cover and back plate to engage the resiliently deflectable one of the second catch members and maintain the same in a position in which the second catch members do not engage.

4. A dispenser as claimed in claim 3 wherein the back plate having at its upper end a central front-to-rear extending slotway open at an upper end and disposed between a pair of rear shoulders, the second catch member on the back plate comprising a finger-like member secured at a lower end to the back plate at a base and extending upwardly through the slotway to a distal end, the finger-like member being resiliently deflectable forwardly relative to the back plate to disengage the second catch members on the cover, the blocking member comprising a bridge member having two end portions and carrying a U-shaped loop at its center, the bridge member adapted to have each of its ends engage on a respective one of the shoulder to bridge across the slotway with the finger-like member being received within the loop such that the loop holds the finger-like member deflected sufficiently forwardly that the finger-like member does not engage the second catch member on the cover thereby permitting vertical sliding of the cover and back plate between the closed position and the intermediate position.

5. A dispenser as claimed in claim 4 wherein the bridge member carries on each of its end portions a locating pin, each of the shoulders on the back plate having an opening adapted to receive a respective one of the locating pins of the bridge member.

6. A dispenser as claimed in claim 4 wherein the cover carries at its upper rear a downwardly directed upper rear flange which includes, as the second catch member on the cover, a central downwardly extending tab which extends downwardly into the slotway of the back plate for engagement with the finger-like member.

7. A dispenser as claimed in claim 6 wherein the tab has a lower camming surface, the finger-like member has an upwardly directed cam surface which extends downwardly towards the rear, in vertical sliding between the raised intermediate position and the closed position, the lower camming surface of the tab engaging the cam surface of the finger-like member to resiliently deflect the finger-like member forwardly to an extent that the tab may pass downwardly therepast.

8. A dispenser as claimed in claim 7 wherein the tab has a catch opening therethrough provided with an upwardly directed lower catch surface, the finger-like member including a downwardly directed catch shoulder under the rear of its cam surface to be disposed within the catch opening of the tab with the catch surface of the tab engaging the catch shoulder of the finger-like member.

9. A dispenser as claimed in claim 8 wherein the rear flange of the cover comprises the first catch member of the cover, the rear flange slides vertically rearward of the rear shoulders of the back plate such that in the closed position the rear flange and the rear shoulders engage to prevent relative pivoting of the cover and back plate and in the intermediate position the rear flange is disposed at a height above the shoulders in the back plate permitting relative pivoting of the cover and back plate between the intermediate position and the open position by relative pivoting.

10. A dispenser as claimed in claim 4 wherein the back plate includes a central rear portion below the shoulders over which the back plate comprises a substantially planar member of relatively constant front-to-rear thickness, the opening through the back plate being provided over such central rear portion, the bridge member having its end portions, U-shaped loop and pins disposed in substantially the same plane as the central rear portion when the blocking member is received in the opening coupled to the back plate in the inoperative position with the U-shaped loop presenting an aperture extending through the back plate forwardly and rearwardly.

* * * * *